US008313045B2

(12) United States Patent
Levitsky

(10) Patent No.: US 8,313,045 B2
(45) Date of Patent: Nov. 20, 2012

(54) LIQUID ATOMIZER FOR AGRICULTURAL APPLICATIONS

(75) Inventor: Michael Levitsky, Beer Sheva (IL)

(73) Assignee: Netafim, Ltd., Tel Aviv (IL)

( * ) Notice: Subject to any disclaimer, the term of this patent is extended or adjusted under 35 U.S.C. 154(b) by 908 days.

(21) Appl. No.: 11/858,584

(22) Filed: Sep. 20, 2007

(65) Prior Publication Data

US 2009/0078795 A1 Mar. 26, 2009

(51) Int. Cl.
*B05B 1/34* (2006.01)
*B05B 1/14* (2006.01)

(52) U.S. Cl. ..... 239/468; 239/472; 239/499; 239/504; 239/590; 239/591

(58) Field of Classification Search ..... 239/463, 239/399, 398, 403, 406, 416.4, 416.5, 417.5, 239/418, 433, 434.5, 461, 468, 492, 472, 239/499, 504, 590, 591
See application file for complete search history.

(56) References Cited

U.S. PATENT DOCUMENTS

| | | | | |
|---|---|---|---|---|
| 2,399,182 | A | 4/1946 | Gustafsson et al. | |
| 3,782,639 | A * | 1/1974 | Boltz et al. | 239/405 |
| 4,134,606 | A | 1/1979 | Menti | |
| 4,231,524 | A * | 11/1980 | Aprea et al. | 239/468 |
| 4,335,804 | A * | 6/1982 | Bardin et al. | 184/55.2 |
| 4,613,079 | A | 9/1986 | Mains | |
| 4,721,253 | A * | 1/1988 | Noguchi et al. | 239/464 |
| 5,018,501 | A * | 5/1991 | Watanabe et al. | 123/472 |
| 5,711,488 | A | 1/1998 | Lund | |
| 5,951,882 | A | 9/1999 | Simmons et al. | |
| 6,186,417 | B1 * | 2/2001 | Ho et al. | 239/491 |
| 6,983,896 | B2 | 1/2006 | Zur et al. | |
| 6,983,900 | B2 * | 1/2006 | Dantes et al. | 239/585.1 |
| 2004/0004063 | A1 * | 1/2004 | Merdan | 219/121.67 |
| 2005/0023376 | A1 * | 2/2005 | Anderson | 239/432 |
| 2007/0018017 | A1 | 1/2007 | Tilton et al. | |

FOREIGN PATENT DOCUMENTS

| | | |
|---|---|---|
| DE | 958 967 | 2/1957 |
| FR | 2 522 537 | 9/1983 |
| JP | 2004 097906 | 4/2004 |

OTHER PUBLICATIONS

International Search Report and Written Opinion in PCT/IL2008/001227, dated Jan. 13, 2009.

* cited by examiner

*Primary Examiner* — Len Tran
*Assistant Examiner* — Justin Jonaitis
(74) *Attorney, Agent, or Firm* — Womble Carlyle

(57) ABSTRACT

A liquid atomizer for agricultural use includes at least one canal in fluid communication via a chamber with an outlet. At least a section of the canal extends along a straight line and tangentially opens into the chamber.

31 Claims, 4 Drawing Sheets

LIQUID ATOMIZER FOR AGRICULTURAL APPLICATIONS

BACKGROUND

The present disclosure relates to liquid atomizers for use in agriculture.

Such liquid atomizers, which may also be referred to as foggers, sprayers, mist devices, humidifiers, etc., emit a fine mist of liquid. This fine mist may be achieved by guiding a liquid jet through a vortex path that causes the jet to swirl and exit the atomizer as a spray. These atomizers may be used for conditioning the environment by increasing humidity such as in a greenhouse.

U.S. Pat. No. 6,983,896, the disclosure of which is incorporated herein by reference, describes an atomizer with a vortex generating member that is fitted with an R-like vortex generating paths. Water flowing through the atomizer is forced to spin in the R-like path and exit as a fine spray of atomized liquid via a narrow outlet after it is swirled.

FIGS. 8 to 10 show a prior art atomizer 100 having a housing 110 with a vortex or swirl chamber 120. Water flowing though the atomizer 100 is directed along a curved canal 130 into a cylindrical section of the chamber 120 and then along a coned section of the chamber 120 until exiting the atomizer 100 as mist.

SUMMARY

The following embodiment and aspects thereof are described and illustrated in conjunction with systems, tools and methods which are meant to be exemplary and illustrative, not limiting in scope.

In an embodiment, a liquid atomizer comprises at least one canal, a swirl chamber and an outlet that are formed therein, the canal being in fluid communication via the chamber with the outlet and the outlet opening out of the atomizer, wherein at least a section of the canal extends along a straight line and tangentially opens into the chamber to thereby form tangential direction and velocity to liquid jets entering the chamber.

In some embodiments, the chamber comprises a cylindrical portion into which the section of the canal opens and a coned portion, the cylindrical portion extending down towards the coned portion and the coned portion tapering down towards the outlet. Opening out of the canal sections into the cylindrical portion assists forming the liquid jets exiting the canals into a uniform flow.

In some embodiments, the canal has a canal face comprising opposing canal sides; a canal side associated with a line included in the canal face and parallel to the straight line tangentially meets a periphery of the cylindrical portion.

In some embodiments, the section of the canal is a closed canal. This closed section may be formed by a part of the atomizer that abuts the open canals to form a ceiling or by forming a closed canal that passes through a portion of the atomizer. In the event that the canals are closed by a ceiling it is preferable that the part forming the ceiling is made of non-metal material with sealing properties.

In some embodiments, the coned portion of the chamber has a cone head angle $\alpha$ greater than or equal to 60 degrees and smaller than or equal to 135 degrees. Other angle values may, inter alia, impair optimal tangential velocity in the swirl chamber and decrease the spray angle exiting the outlet.

In addition to the exemplary aspects and embodiment described above, further aspects and embodiments will become apparent by reference to the figures and by study of the following detailed descriptions.

BRIEF DESCRIPTION OF THE FIGURES

Exemplary embodiments are illustrated in referenced figures. It is intended that the embodiments and figures disclosed herein are to be considered illustrative, rather than restrictive. The disclosure, however, both as to organization and method of operation, together with objects, features, and advantages thereof, may best be understood by reference to the following detailed description when read with the accompanying figures, in which.

Figure 1:
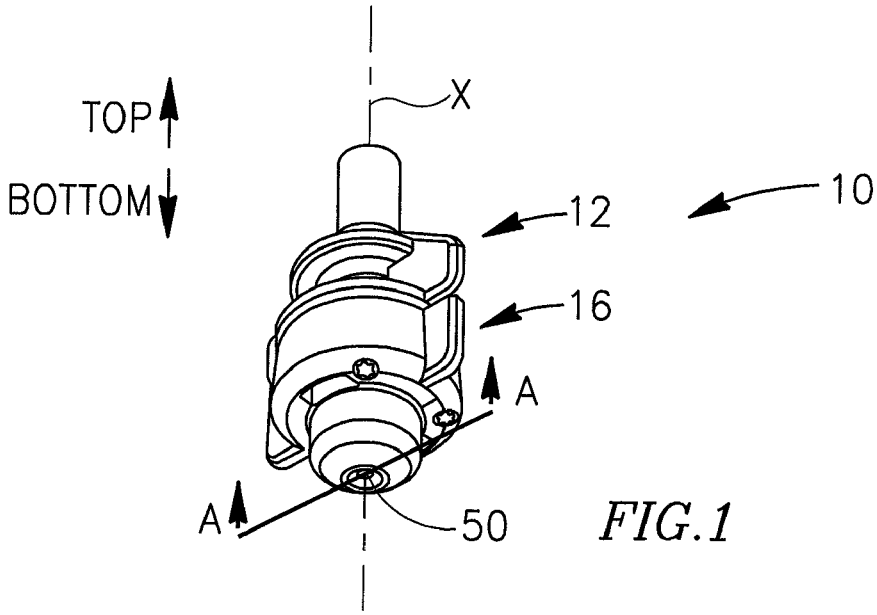
FIG. 1 shows a perspective bottom view of a liquid atomizer in accordance with the present disclosure.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated within the figures to indicate like elements.

DETAILED DESCRIPTION

Figure 2:
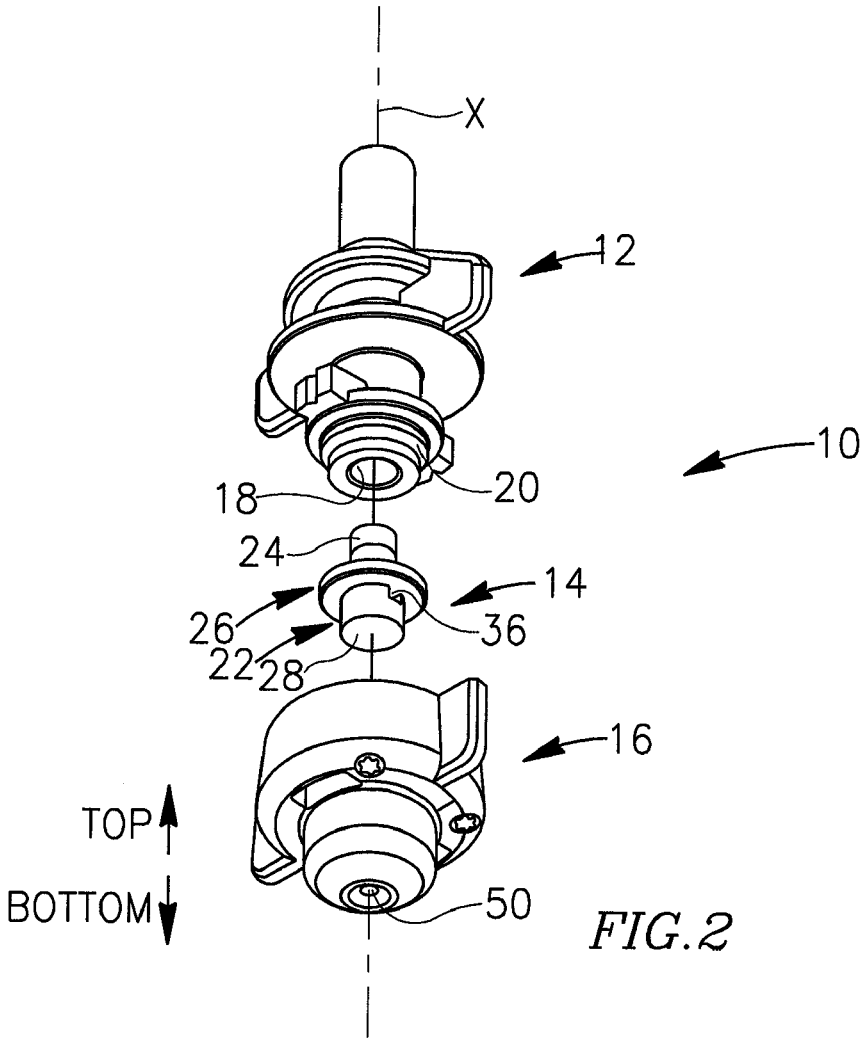
FIG. 2 shows an exploded view of the atomizer.

Attention is first drawn to FIGS. 1 and 2 showing a pressure liquid atomizer 10 having an adaptor 12, a bushing 14 and a housing 16. Liquid from a liquid source (not shown), at a typical inlet pressure of between 3 to 5 bars, flows into the atomizer 10 via the adaptor 12 and is emitted from the atomizer 10 as a spray via an outlet 50 of the housing 16. The atomizer 10 is preferably formed from materials that are resistant to damage caused by plant nutrients and other materials that may be used in agriculture. Optionally, at least some of the parts of the atomizer are formed from Polybutylene terephthalate (PBT).

The atomizer 10 has a longitudinal axis X defining opposing top and bottom directions therealong. It should be noted that directional terms appearing throughout the specification and claims, e.g. "top", "bottom", etc., (and derivatives thereof) are for illustrative purposes only, and are not intended to limit the scope of the appended claims. In addition it is noted that the directional terms "bottom", "down", "below" and "lower" (and derivatives thereof) define identical directions and the directional terms "top", "up", "above" (and derivatives thereof) define identical directions.

Figure 3:
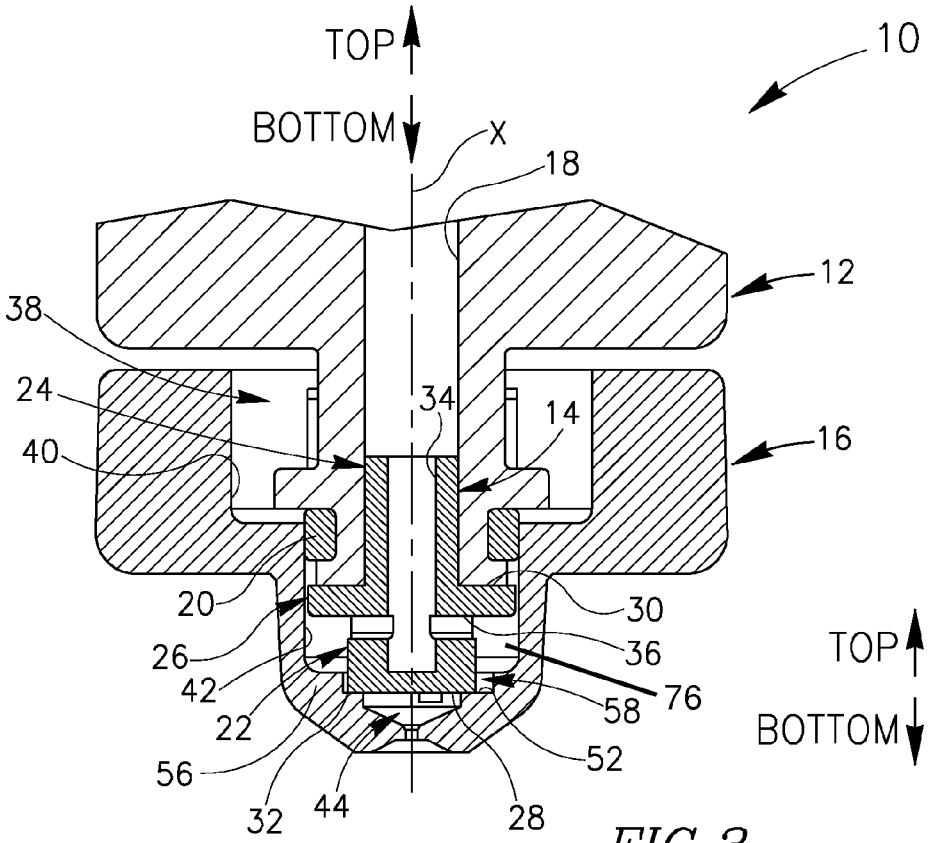
FIG. 3 shows a partial cross sectional view of the atomizer taken in the plane A-A in FIG. 1.
Figure 4:
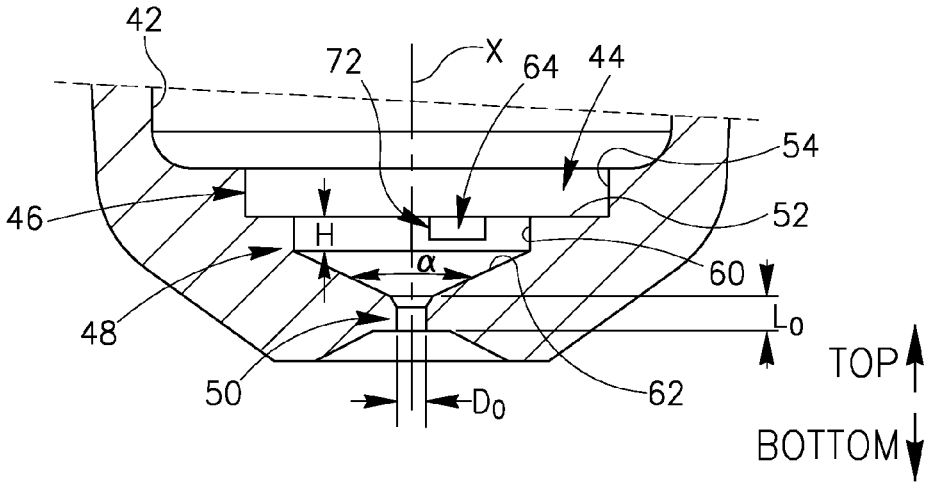
FIG. 4 shows a partial cross sectional view of a housing of the atomizer taken in the plane A-A in FIG. 1.

Attention is additionally drawn to FIGS. 3 and 4. The adaptor 12 has an axially extending lumen 18 that opens out to top and bottom ends thereof and a gasket 20 of the adaptor 12 surrounds a bottom portion thereof. The bushing 14 has a lower cylindrical shank 22, an upper cylindrical rod 24 and an annular ring 26 therebetween. The shank 22 has a downwardly facing base 28 at a lower end thereof and the ring 26 has an upwardly facing annular support 30. A base edge 32 is defined at the intersection of the base 28 with a periphery of the shank 22.

An axially extending main channel 34 and two minor channels 36 are formed in the bushing 14. The main channel 34 is closed at a bottom end and opens out to an upper end of the bushing 14. The minor channels 36 communicate with the main channel 34 and extend laterally to open out at opposing sides of the periphery of the shank 22.

The housing 16 has an axially extending cavity 38 having an upper portion 40, a lower portion 44 and a middle portion 42 therebetween. The upper and middle portions 40, 42 are cylindrical and coaxial and the middle portion 42 has a smaller diameter than the upper portion 40. The lower portion 44 (best seen in FIG. 4) has an inlet 46, an outlet 50 and a swirl chamber 48 therebetween. The inlet 46 has an upwardly facing floor 52 at a lower end thereof and a peripheral wall 54. The inlet 46 extends down from the cavity's middle portion 42 to the floor 52.

Figure 5:
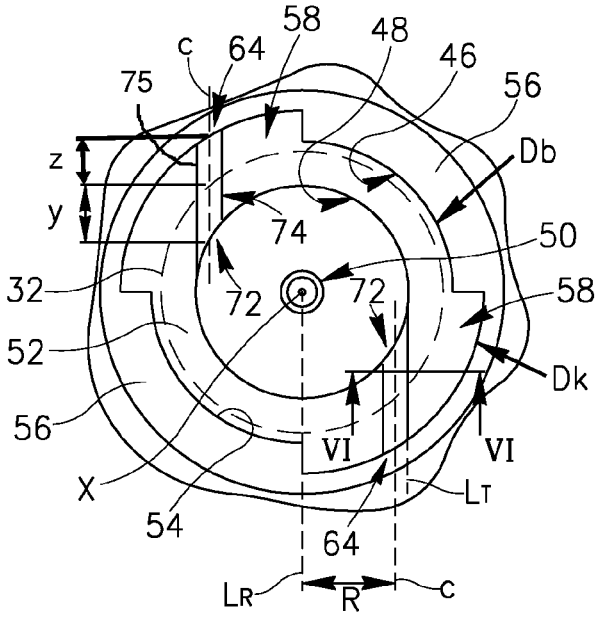
FIG. 5 shows a top view of the housing of the atomizer.
Figure 6:
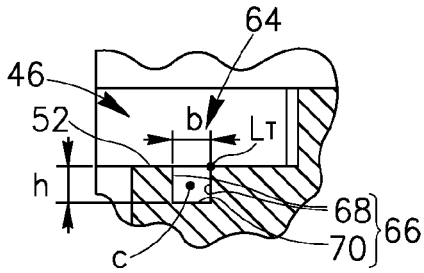
FIG. 6 shows a partial cross sectional view of the housing taken along the line VI-VI in FIG. 5.

Attention is additionally drawn to FIGS. 5 and 6. Two bulges 56 of the housing 16, symmetrically distributed about the axis X, project into the inlet 46. A keyway 58 of the inlet 46 is defined as a portion of the inlet 46 located annularly between adjacent bulges 56. A portion of the wall 54 facing into the inlet 46 and located on each bulge 56 lies on a segment of a cylinder having an axis coinciding with X and a diameter Db. A portion of the wall 54 bounding each keyway 58 and facing into the inlet 46 lies on a segment of a cylinder having an axis coinciding with X and a diameter Dk which is larger than Db.

The swirl chamber 48 opens out to the inlet 46 at the floor 52 where it is bounded from above by the base 28 of the bushing 14 of the atomizer. The swirl chamber 48 has an upper peripheral barrel face 60 and a lower peripheral cone face 62 (best seen in FIG. 4). The barrel face 60 extends a distance H axially down from the floor 52 of the inlet 46 and the cone face 62 tapers down from the barrel face 60 to the outlet 50 at a cone head angle a. The outlet 50 communicates with the swirl chamber 48 and has an axially extending cylindrical shape that extends downwardly therefrom and opens out of the housing 16. The outlet 50 has a length Lo along the axis and a diameter Do.

The housing 16 has two canals 64 symmetrically distributed about the axis X that are formed therein (best seen in FIG. 5). Each canal 64 extends along a straight canal axis C and has a canal face 66. The canal face 66 has opposing sides 68 equally spaced from the canal axis C and an upwardly facing ground 70 that extends between the sides 68. The canal 64 opens out to the inlet 46 at the floor 52. In contrast to the curved canal 130 which opens to the swirl chamber 120 of the prior art atomizer 100, a straight portion of the canal 64, at one side 68 of the canal face 66, tangentially meets the peripheral barrel face 60 of the swirl chamber 48 and so the canal 64 opens out to the swirl chamber 48 at a merge 72 located on the barrel face 60. A width b of the canal 64 is measured between the sides 68 and a height h of the canal 64 is measured between the ground 70 of the canal 64 and the floor 52 of the inlet 46. In a plane perpendicular to the axis X and including the canal axes C, a swirl radius R of the atomizer 10 is defined as the open distance in the swirl chamber between a given canal axis C and a first line $L_R$ parallel to the canal axis C and intersecting the axis X. Preferably, a second line $L_T$ parallel to the canal axis C and lying on the canal face 66 is tangential to the barrel face 60 at the merge 72, and so the canal side 68 associated with the second line $L_T$ also tangentially meets the peripheral barrel face 60 of the swirl chamber 48 (See FIGS. 5 & 6). It is noted that embodiments of an atomizer 10 in accordance with the present disclosure may have one canal 64 or more than two canals 64 and respectively one or more than two key ways 58 and minor channels 36.

Attention is drawn back to FIG. 3. In an assembled state of the atomizer 10 the bushing 14 is first attached to the adaptor 12 by urging the rod 24 of the bushing 14 into the lumen 18 of the adaptor 12 until a bottom end of the adaptor 12 abuts the support 30 of the bushing 14. The adaptor 12 and bushing 14 are then urged into the cavity 38 of the housing 16 with the bushing 14 leading until the bushing's shank 22 is snugly received between the bulges 56 and the bushing's base 28 abuts the inlet's floor 52. It will be understood from hereon that any reference to the atomizer 10 refers to the atomizer 10 in its assembled state.

Attention is additionally drawn to FIG. 5 with a note that the base edge 32 is marked in this figure with a dashed line. The base 28 of the bushing 14 in the atomizer 10 covers inner sections of the canals 64 to form covered canal sections 74 having a length y measured along the canal axis C between the base edge 32 and the merge 72. While the inner, covered canal sections 74 are sealed from above by the bushing, outer sections of the canals 64 are not sealed from above by the bushing 14 and constitute uncovered canal sections 75 having a length z measured along the canal axis C between the wall 54 and the base edge 32. Since the canal axes C are straight, the uncovered canal sections 75 are collinear with their associated covered canal sections 74. During operation of the atomizer 10, liquid flows downwardly through the lumen 18 into the main channel 34 of the bushing 14 and from there diverges sideways via the minor channels 36 into a region 76 between the bushing 14 and the housing 16 in the middle portion 42 of the cavity 38 below the gasket 20. The liquid then flows down via the keyways 58 into the uncovered canal sections 75 of the canals 64, which are not sealed from above by the bushing 14, and then via the covered canal sections 74 tangentially into the swirl chamber 48 wherein it swirls along the barrel and cone faces 60, 62 until exiting the atomizer 10 via the outlet 50 as a spray. It is noted that the opening of the covered canal sections 74 into the barrel face of the swirl chamber helps shape the jets exiting the covered canal sections 74 into a uniform flow before the exiting via the outlet.

The inventor performed studies of the efficiency of an atomizer 10 in accordance with the present disclosure. The studies indicate that when at least some of the parameters h, b, R, y, H, Lo and Do comply with the following relationships, an atomizer 10 in accordance with the present disclosure emits a fine liquid spray. Optionally, under liquid pressure of about 0.4 MPa an embodiment of the atomizer 10 emits a spray with liquid particles having a Sauter Mean Diameter (SMD) optionally smaller than 80 μm and preferably smaller than 60 μm. It is noted that some of the following relations are dependant upon each other.

For optimal tangential velocity in the swirl chamber 48, the angle α is optionally within the range of $60° < \alpha < 135°$ and the relative length of the outlet 50 is optionally within the range of $$0.25 \leq \frac{L_0}{D_0} \leq 1.$$

The relative length of the closed canal sections 74 is optionally $$\frac{y}{b} \geq 1.5$$

for the liquid entering the swirl chamber 48 to acquire optimal tangential direction and velocity. The relation between the width and height of each closed canal section 74 is optionally $$0.8 \leq \frac{b}{h} \leq 1.3$$

to provide an optimal inlet area into the swirl chamber 48. The relation between the total inlet areas into the swirl chamber 48 and the total outlet area out of the swirl chamber 48 is optionally $$0.9 \leq \frac{Nbh}{\pi r^2} \leq 1.9$$

(wherein N is the number of canals and r=Do/2). The relation between the heights of the swirl chamber's barrel face 60 and the canals 64 is optionally $$1.2 \leq \frac{H}{h} \leq 1.8.$$

And finally, to minimize hydraulic losses in the swirl chamber 48 the following relation should optionally be obtained $$2.9 \leq \frac{\pi Rr}{Nbh} \leq 5$$

(wherein N is the number of canals and r=Do/2).

By way of a numerical example, an atomizer 10 in accordance with an embodiment of the present disclosure with two canals has the following dimensions. h=0.4 mm, b=0.4 mm, R=1.7 mm, y=0.96 mm, H=0.6 mm, Lo=0.5 mm and Do=0.53 mm.

Figure 7:
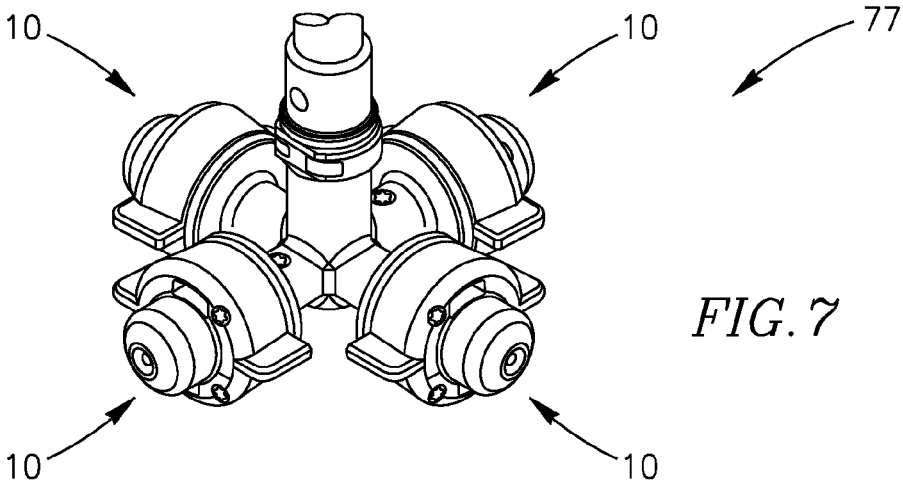
FIG. 7 shows a perspective view of an atomizer head incorporating atomizers in accordance with the present disclosure.
Figure 8:
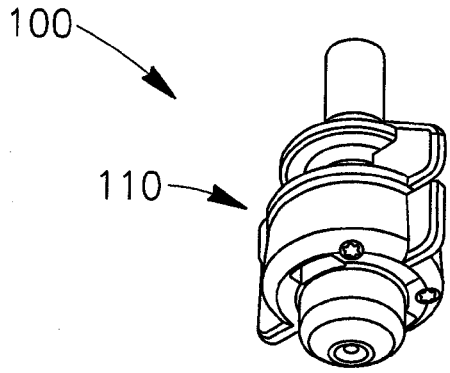
FIG. 8 (PRIOR ART)
FIG. 8 shows a perspective bottom view of a prior art atomizer.
Figure 9:
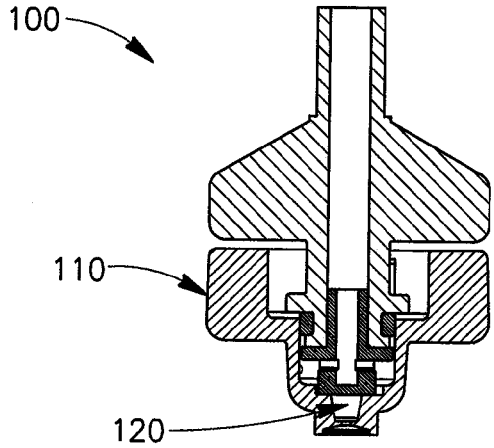
FIG. 9 (PRIOR ART)
FIG. 9 shows a longitudinal cross sectional view of the prior art atomizer.
Figure 10:
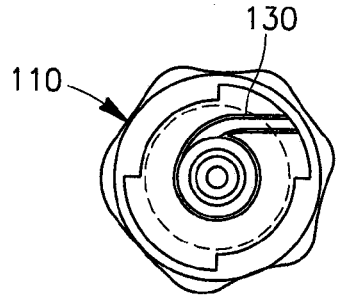
FIG. 10 (PRIOR ART)
FIG. 10 shows an enlarged top view of a housing of the prior art atomizer.

Attention is drawn to FIG. 7. An atomizer head 77 in accordance with an embodiment of the present disclosure comprises four atomizers 10 that emit each a liquid spray. In addition it is noted that an atomizer head 77 in accordance with an embodiment of the present disclosure can comprise a configuration of a plurality of atomizers 10, such as a "T" or a "star" configuration.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

Although the present embodiment has been described to a certain degree of particularity, it should be understood that various alterations and modifications could be made without departing from the scope of the disclosure as hereinafter claimed.

What is claimed is:

1. A liquid atomizer having a longitudinal axis (X) and comprising:

a housing having formed therein at least one canal, a swirl chamber and an outlet, the canal being in fluid communication via the swirl chamber with the outlet and the outlet opening out of the atomizer, wherein:

the swirl chamber comprises a cylindrical portion and a coned portion, the cylindrical portion extending down towards the coned portion and the coned portion tapering down towards the outlet;

the canal opens into the swirl chamber and has a canal face comprising a canal side which tangentially meets a periphery of the cylindrical portion of the swirl chamber;

the swirl chamber is bounded on one side by a base portion of a bushing belonging to the liquid atomizer, the bushing being distinct from the housing and the canal formed therein;

a first section of the canal having a first length is sealed from above by a portion of the bushing and constitutes a covered canal section; and a second section of the canal having a second length is not sealed from above by the bushing and constitutes an uncovered canal section.

2. A liquid atomizer according to claim 1, wherein the coned portion of the swirl chamber has a cone head angle $\alpha$ greater than or equal to 60 degrees.

3. A liquid atomizer according to claim 2, wherein the angle $\alpha$ is smaller than or equal to 135 degrees.

4. A liquid atomizer according to claim 1, wherein the outlet has a diameter Do and extends along a length Lo to open out of the atomizer, and wherein a relation Lo/Do is greater than or equal to 0.25.

5. A liquid atomizer according to claim 4, wherein the relation Lo/Do is smaller than or equal to 1.

6. A liquid atomizer according to claim 1, wherein the covered canal section extends along a length y and has a width b, and wherein a relation y/b is greater than or equal to 1.5.

7. A liquid atomizer according to claim 1, wherein the covered canal section has a width b and a height h, and a relation b/h is greater than or equal to 0.8.

8. A liquid atomizer according to claim 7, wherein the relation b/h is smaller than or equal to 1.3.

9. A liquid atomizer according to claim 1, wherein a relation between the total inlet area into the swirl chamber via any covered canal sections and the total outlet area out of the swirl chamber via the outlet is greater than or equal to 0.9.

10. A liquid atomizer according to claim 9, wherein the relation is smaller than or equal to 1.9.

11. A liquid atomizer according to claim 1, wherein the cylindrical portion extends down a height H and the canal has a height h, and wherein a relation H/h is greater than or equal to 1.2.

12. A liquid atomizer according to claim 11, wherein the relation H/h is smaller than or equal to 1.8.

13. A liquid atomizer according to claim 1, wherein:

the swirl chamber has a swirl radius R defined as the open distance in the swirl chamber between a straight canal axis (C) and a line ($L_R$) which is parallel to the straight canal axis (C) and intersects the longitudinal axis X;

the outlet has a shape of a cylinder with a radius r through which liquid may flow;

the number of canals in the atomizer is N;

each canal has a width b and a height h; and wherein a relation $$\frac{\pi Rr}{Nbh}$$

is greater than or equal to 2.9.

14. A liquid atomizer according to claim 13, wherein the relation $$\frac{\pi Rr}{Nbh}$$

is smaller than or equal to 5.

15. A liquid atomizer according to claim 1, wherein at least a portion of the atomizer exposed to liquid flowing therethrough is formed from PBT.

16. A liquid atomizer according to claim 1, comprising:

at least two canals in fluid communication with the outlet via the swirl chamber; wherein:

the at least two canals are symmetrically distributed about a longitudinal axis of the atomizer; and each canal has a section that extends along a straight line and tangentially opens into the swirl chamber.

17. An atomizer head comprising a plurality of liquid atomizers, each liquid atomizer having a longitudinal axis (X) and comprising:

a housing having formed therein at least one canal, a swirl chamber and an outlet, the canal being in fluid communication via the swirl chamber with the outlet and the outlet opening out of the atomizer, wherein:

the swirl chamber comprises a cylindrical portion and a coned portion, the cylindrical portion extending down towards the coned portion and the coned portion tapering down towards the outlet;

the canal opens into the swirl chamber and has a canal face comprising a canal side which tangentially meets a periphery of the cylindrical portion of the swirl chamber;

the swirl chamber is bounded on one side by a base portion of a bushing belonging to said each liquid atomizer, the bushing being distinct from the housing;

a first section of the canal having a first length is sealed from above by a portion of the bushing and constitutes a covered canal section; and a second section of the canal having a second length is not sealed from above by the bushing and constitutes an uncovered canal section.

18. A liquid atomizer having a longitudinal axis (X) and comprising:

an adaptor having an axially extending lumen;

a bushing having an axially extending main channel and at least one laterally extending minor channel, the axially extending main channel of the bushing being in fluid communication with the axially extending lumen of the adaptor; and a housing having an axially extending cavity comprising a housing inlet and a housing outlet, the at least one laterally extending minor channel of the bushing being in fluid communication with the housing inlet;

a canal in fluid communication with the housing inlet; and a swirl chamber in fluid communication with the canal and also with the housing outlet, thereby forming a fluid path between the axially extending lumen of the adaptor and the housing outlet, which fluid path includes, in order, the axially extending lumen of the adaptor, the bushing's main channel, the bushing's at least one minor channel, the housing inlet and the canal;

wherein:

the canal opens into the swirl chamber and has a canal face comprising a canal side which tangentially meets a periphery of a cylindrical portion of the swirl chamber.

19. A liquid atomizer according to claim 18, wherein:

the swirl chamber further comprises a coned portion, the cylindrical portion of the swirl chamber extending down towards the coned portion and the coned portion tapering down towards the outlet;

the swirl chamber has a swirl radius R defined as the open distance in the swirl chamber between a straight canal axis (C) and a line ($L_R$) which is parallel to the straight canal axis (C) and intersects the longitudinal axis X;

the outlet has a shape of a cylinder with a radius r through which liquid may flow, the number of canals in the atomizer is N;

each canal has a width b and a height h; and wherein a relation $$\frac{\pi Rr}{Nbh}$$

is greater than or equal to 2.9.

20. A liquid atomizer according to claim 19, wherein the relation $$\frac{\pi Rr}{Nbh}$$

is smaller than or equal to 5.

21. A liquid atomizer according to claim 18, wherein the outlet has a diameter Do and extends along a length Lo to open out of the atomizer, and wherein a relation Lo/Do is greater than or equal to 0.25.

22. A liquid atomizer according to claim 21, wherein the relation Lo/Do is smaller than or equal to 1.

23. A liquid atomizer having a longitudinal axis (X) and comprising:

an adaptor having an axially extending lumen;

a bushing having an axially extending main channel and at least one laterally extending minor channel, the axially extending main channel of the bushing being in fluid communication with the axially extending lumen of the adaptor; and a housing having an axially extending cavity comprising a housing inlet and a housing outlet, the at least one laterally extending minor channel of the bushing being in fluid communication with the housing inlet;

a canal in fluid communication with the housing inlet; and a swirl chamber in fluid communication with the canal and also with the housing outlet, thereby forming a fluid path between the axially extending lumen of the adaptor and the housing outlet, which fluid path includes, the bushing's main channel, the bushing's at least one minor channel, the housing inlet and the canal;

wherein:

the canal opens into the swirl chamber and has a canal face comprising a canal side which tangentially meets a periphery of a cylindrical portion of the swirl chamber; and a section of the canal is sealed from above by a portion of the bushing, thereby forming a covered canal section.

24. A liquid atomizer according to claim 23, wherein the covered canal section extends along a length y and has a width b, and wherein a relation y/b is greater than or equal to 1.5.

25. A liquid atomizer according to claim 23, wherein the covered canal section has a width b and a height h, and a relation b/h is greater than or equal to 0.8.

26. A liquid atomizer according to claim 25, wherein the relation b/h is smaller than or equal to 1.3.

27. A liquid atomizer according to claim 23, wherein a relation between the total inlet area into the swirl chamber via any covered canal sections and the total outlet area out of the swirl chamber via the outlet is greater than or equal to 0.9.

28. A liquid atomizer according to claim 27, wherein the relation is smaller than or equal to 1.9.

29. A liquid atomizer according to claim 19, wherein the cylindrical portion extends down a height H and the canal has a height h, and wherein a relation H/h is greater than or equal to 1.2.

30. A liquid atomizer according to claim 29, wherein the relation H/h is smaller than or equal to 1.8.

31. The liquid atomizer according to claim 1, comprising a fluid path which includes, in order:

(a) at least one channel formed in the bushing;

(b) a region between the bushing and a housing of the atomizer;

(c) the uncovered canal section of the at least one canal;

(d) the covered canal section of the at least one canal; and (e) the swirl chamber.

* * * * *